US006986165B2

(12) United States Patent
Neff et al.

(10) Patent No.: US 6,986,165 B2
(45) Date of Patent: Jan. 17, 2006

(54) EXTENDABLE COLLAR

(75) Inventors: David Neff, Glen Carbon, IL (US); Megan Smith, Stoughton, MA (US)

(73) Assignee: Designs Apparel, Inc., Canton, MA (US)

( * ) Notice: Subject to any disclaimer, the term of this patent is extended or adjusted under 35 U.S.C. 154(b) by 151 days.

(21) Appl. No.: 10/631,442

(22) Filed: Jul. 30, 2003

(65) Prior Publication Data

US 2005/0022287 A1 Feb. 3, 2005

(51) Int. Cl.
*A41B 3/02* (2006.01)

(52) U.S. Cl. ..... 2/141.2; 2/129

(58) Field of Classification Search ..... 2/141.2, 2/141.1, 140, 142, 76, 77, 106, 113–116, 2/121–123, 127–136, 139, 235–237, 219–221
See application file for complete search history.

(56) References Cited

U.S. PATENT DOCUMENTS

| | | | | | |
|---|---|---|---|---|---|
| 418,639 | A | * | 12/1889 | Batter | 2/127 |
| 1,086,451 | A | * | 2/1914 | Glasgow | 2/127 |
| 1,963,004 | A | * | 6/1934 | Tucker | 2/127 |
| 2,025,485 | A | * | 12/1935 | Tucker | 2/127 |
| 2,385,638 | A | * | 9/1945 | Norwood | 2/116 |
| 2,418,772 | A | * | 4/1947 | Jackson | 2/235 |
| 2,585,689 | A | * | 2/1952 | Schafer | 2/127 |
| 3,042,932 | A | * | 7/1962 | Eppy | 2/236 |
| 4,000,522 | A | * | 1/1977 | Swanson | 2/116 |
| 4,193,136 | A | * | 3/1980 | Pierce | 2/237 |
| 4,580,298 | A | * | 4/1986 | Tuisl | 2/237 |
| 4,648,137 | A | * | 3/1987 | Cooper | 2/116 |
| 4,825,472 | A | * | 5/1989 | Garafano | 2/116 |
| 4,937,884 | A | * | 7/1990 | Sherman | 2/129 |
| 4,947,489 | A | * | 8/1990 | Greenwood | 2/304 |
| 5,692,240 | A | * | 12/1997 | Steele | 2/129 |
| 6,081,926 | A | * | 7/2000 | Krause et al. | 2/129 |
| 6,085,356 | A | * | 7/2000 | Redmond, Sr. | 2/237 |
| 6,434,802 | B1 | * | 8/2002 | Pannone | 24/306 |
| 6,449,775 | B1 | * | 9/2002 | Battaglia | 2/312 |
| 6,715,155 | B2 | * | 4/2004 | Duflos | 2/237 |

FOREIGN PATENT DOCUMENTS

GB 2242816 A * 10/1991

OTHER PUBLICATIONS

Gerhsman, Maurice, "Self Adhering Nylon Tapes", Journal of the American Medical Association, vol. 168, No. 7, p. 930, Oct. 1958.*

* cited by examiner

*Primary Examiner*—John J. Calvert
*Assistant Examiner*—Alissa L. Hoey
(74) *Attorney, Agent, or Firm*—Wolf, Greenfield & Sacks, P.C.

(57) ABSTRACT

A shirt collar for dress or sport shirts with an adjustable collar secured to the shirt body by a collar stand. An elongated fabric strip positioned within a fold in the collar band with one end projecting through a slot and with a button secured to its end and with the other end connected to an elastic strip, in turn secured to the collar band. The button may be engaged with the button hole on the other side of the collar band.

5 Claims, 1 Drawing Sheet

EXTENDABLE COLLAR

SUBJECT MATTER OF INVENTION

The present invention relates to the collar band construction of shirts and, in particular, dress and sport shirts.

BACKGROUND OF INVENTION

Conventional dress and sport shirts are ordinarily fabricated with collar constructions shaped and cut to a particular neck size. While many shirts suggest the shirt is adapted for a small range of sizes, as a practical matter that is not the case since the shirt collar bands are ordinarily made with non-stretchable components that have no give or yield once the shirt is buttoned to the neck.

Some shirts have been designed in efforts to provide some stretchability of the shirt in the neck. These efforts, insofar as known, do not provide as great a comfort as one would wish, does not have the same reliability and performance as might be desired for shirts having substantial qualities. In particular, prior designs may permit too much stretching and thereby result in shirts with stretched collars that have unsightly appearances and elastic or stretchable systems that do not stand up to wear and ultimately fail. These prior art systems are also uncomfortable to the wearer since the components used to permit adjustable neck sizes are frequently bulky and; uncomfortable to wear.

It is an object of the present invention to provide an improved shirt collar mechanism that allows a wearer to dynamically adjust a collar size over a defined length as, for example, one whole size while at all times maintaining an appropriate; appearance of the shirt collar when properly worn. A further object of the present invention is to provide a dynamically adjustable shirt collar that accommodates changes in a person's neck size on a long-term basis, as will occur when the wearer either gains or loses weight, or on a short-time basis when the wearer sneezes or otherwise flexes his neck.

A shirt collar designed primarily for dress or sports shirts is provided in which an adjustable collar is secured to the shirt body by a collar stand or collar band in a conventional fashion. An elongated length of fabric or strip is positioned within a fold in the collar band, with one end projecting through a slot or button hole in the collar band, and having a button secured to one end of the strip. The other end of the elongated strip is fixed to one side of an elastic member with the other side of the elastic member bar-tacked to the collar band. The button stitched to the one end of the strip is normally aligned with and interengaged with a button hole on the opposite side of the collar band when the shirt collar is closed.

DESCRIPTION OF DRAWINGS

The foregoing objects and advantages of the present invention will be more clearly understood when considered in conjunction with the accompanying drawings in which.

DETAILED DESCRIPTION OF EMBODIMENTS

The present invention may be used on a wide range of shirts including, for example, dress shirts and sports shirts made of a wide range of materials. Typically, fabrics may vary but in a particular example the fabrics used in practicing this invention may be blended fabrics such as a 60% cotton and 40% polyester fabric material. Other blended or non-blended material and synthetic fabrics, conventional in shirt manufacturing may be used.

A collar assembly 10 is secured to the collar stand 16. The collar assembly 10 may have a variety of shapes and styles. In the embodiment illustrated, the collar is a pointed collar and is illustrated as secured to a collar stand 16 having a placket front 14, although French fronts may also be used in practicing this invention. The collar stand 16 is in turn secured to the shirt body 12 as noted below.

Figure 1:
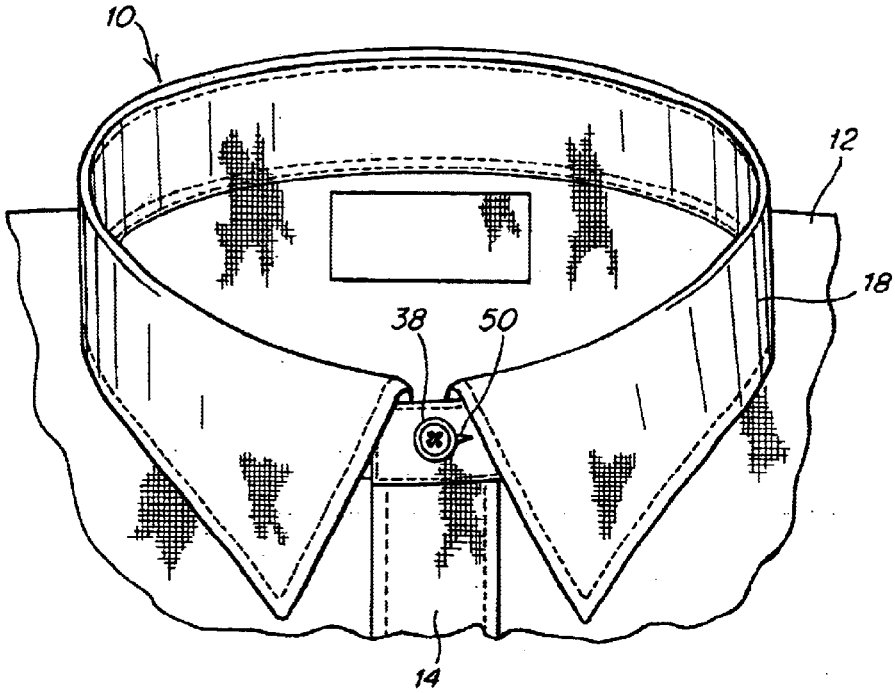
FIG. 1 is a closed view of a shirt collar and segment of a shirt embodying our invention.
Figure 2:
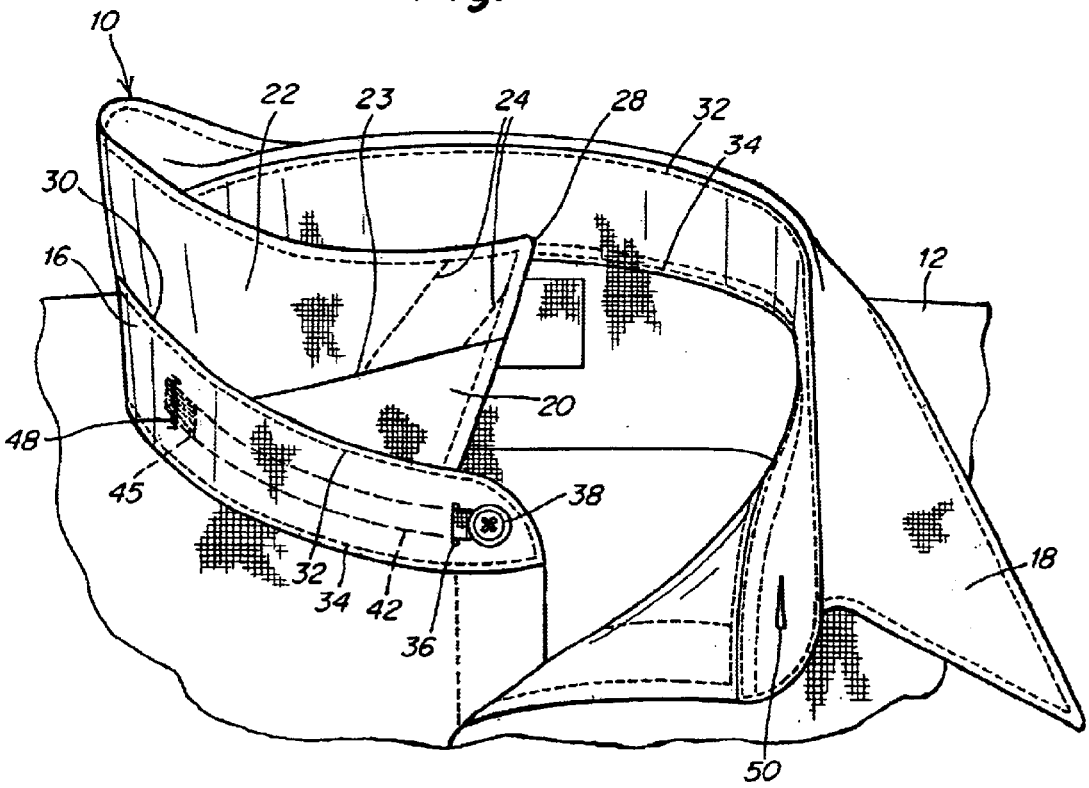
FIG. 2 is an open view of the shirt collar of FIG. 1 with the collar unbuttoned.

The collar assembly 10 may be made in a wide range of styles and using a wide range of collar fabrication techniques. Typically, the collar assembly 10 is secured to a collar band or collar stand 16. The collar assembly 10 is conventionally formed with an outer ply 18 and an integrally formed and fold over inner ply 20 (FIG. 2). Conventionally, an interfacing or stiffener (not shown) may be interposed between the inner and outer ply to give body to the collar assembly. Additionally, an inner self fabric 22 may also be stitched to the inner ply 20 with the inner self fabric 22 cut along a bias 23 at one end of the collar. Parallel stitching 24 extending from the collar point 28 securing the inner self fabric 22 and inner ply together forms an elongated pocket shaped to receive a collar stay. A similar construction may be provided at each collar point 28. The collar band 16 may be secured to a band of the shirt body 12 at its neck opening with the border 30 secured by parallel lines of stitching 32 and 34, extending through the collar band and the shirt body 12. These bands of stitching, 32 and 34, define a pocket between the collar band 16 and shirt body 12. A slot 36 formed similar to a button hole is positioned in the pocket defined by the collar band 16 and shirt body 12. An elongated strip of self fabric 42 having a preferred length of three inches extends through the slot 36 with a button 38 cross-stitched to the one end of the self fabric strip 42. The other end of the self fabric strip 42 is stitched to one edge of a piece of elastic 45 having dimensions of ⅜" long and ⅜" wide. The other edge of this elastic fabric square 45 is bar tacked at 48 to the shirt body and/or collar band. The elastic 45 is preferably a composite material of 35% rubber thread (375W) and 65% polyester yard (150/300D) with the elastic formed on a suitable weaving crochet machine that weaves the rubber thread and yarn into an elasticity of 100:300.

The ⅜" square dimension of the elastic fabric square material and the 3" length of the self fabric strip 42 are selected to permit the button 38 to be stretched approximately ½".

The button 38 is aligned with a button hole 50 at the upper end of the placket 14 when the shirt is closed and the elastic fabric 45 is not stretched. The button hole 50 may be formed in French fronts as well as in the placket illustrated. It is, conventionally, aligned with a series of other buttons and button holes in the shirt body.

We claim:

1. A collared shirt having means for dynamically adjusting the dimension of the neck opening comprising a shirt body having an opening extending downwardly from a neck opening in the front of the shirt, a collar assembly extending about the neck opening and comprising a collar, a collar band extending from an edge of the collar to the edge of the neck opening, means defining a pocket, extending at least a portion of the circumference of the collar band from one end thereof, with the pocket between the outer surface of the collar band and shirt body from the neck opening and having a strip opening positioned near the neck opening and extending downwardly, a self fabric strip about 3" long and having a width about half the width of the collar band positioned with one end within the pocket and a section at the other end projecting through the strip opening, a button secured to the other end of the strip and aligned when the strip is unstressed in normal alignment with a button hole at the other end of the collar band, and an elastic member connected to the one end of the strip and on the other side to the fabric defining the pocket.

2. A shirt as set forth in claim 1 wherein the elastic member is stretchable to about twice its unstretched length.

3. A shirt as set forth in claim 2 having a placket in which the button hole extends through the upper end of the placket.

4. A shirt as set forth in claim 1 wherein the elastic member is formed of a composite material including a minor percentage of rubber thread with the elastic member stretchable in its length over a range of about 3/1.

5. A shirt as set forth in claim 1 wherein the elastic member has a length in the order of ⅜".

* * * * *